US012543898B2

(12) United States Patent
Chen

(10) Patent No.: US 12,543,898 B2
(45) Date of Patent: Feb. 10, 2026

(54) RECLINING MOVABLE BATH CHAIR

(71) Applicant: NEW ALLIED CORPORATION, Taichung (TW)

(72) Inventor: Jui-Hsiao Chen, Taichung (TW)

(73) Assignee: NEW ALLIED CORPORATION, Taichung (TW)

( * ) Notice: Subject to any disclaimer, the term of this patent is extended or adjusted under 35 U.S.C. 154(b) by 133 days.

(21) Appl. No.: 18/626,797

(22) Filed: Apr. 4, 2024

(65) Prior Publication Data

US 2025/0248571 A1 Aug. 7, 2025

(30) Foreign Application Priority Data

Feb. 7, 2024 (TW) ..... 113201633

(51) Int. Cl.
*A47K 3/12* (2006.01)
*A47C 1/024* (2006.01)

(52) U.S. Cl.
CPC ..... *A47K 3/12* (2013.01); *A47C 1/024* (2013.01)

(58) Field of Classification Search
CPC ..... A47K 3/12; A47C 1/024; A47C 1/0244; A61G 5/1075; A61G 5/14
See application file for complete search history.

(56) References Cited

U.S. PATENT DOCUMENTS 4,555,121 A * 11/1985 Lockard ..... A61G 5/00 280/30
4,614,246 A * 9/1986 Masse ..... A61G 5/101 297/344.14
4,732,423 A * 3/1988 Condon ..... A61G 5/00 297/302.6

(Continued)

FOREIGN PATENT DOCUMENTS

EP 0250207 A2 * 12/1987 ..... A47C 1/03283

OTHER PUBLICATIONS

Juiwere brand shower chair. Item model No. Juiwere-01. < https://www.amazon.com/Juiwere-Reclining-Wheelchair-Headrest-Commodes/dp/B0BQ6D4BR9/>. First date available: Dec. 15, 2022. Retrieved: Sep. 26, 2025. (Year: 2022).*

(Continued)

*Primary Examiner* — Joshua J Michener
*Assistant Examiner* — Michael B. Kreiner
(74) *Attorney, Agent, or Firm* — MUNCY, GEISSLER, OLDS & LOWE, P.C.

(57) ABSTRACT

The present invention is relative to a reclining movable bath chair, which includes a seat frame, a base, a pair of gas cylinders, a pair of backrest tubes, and a headrest. The base supports movement of the seat frame, and the two gas cylinders are pin connected to the lower part of the base to enable the seat frame to raise and descend. The additionally fitted pin connected handles, linkage support rods, and upper tubes are all straight tubes to enable increasing the distance (Continued)

between the headrest and a caregiver, thereby creating a safe distance and achieving an improved safety factor standard for the caregiver. Moreover, the gas cylinders enable buffering the speed of raising and descending when tilting the bath chair, at which time the headrest and other components being displaced downward will not suddenly impact the caregiver and cause injury.

5 Claims, 10 Drawing Sheets

(56) References Cited

U.S. PATENT DOCUMENTS 5,240,277 A * 8/1993 Scheulderman ..... A61G 5/1059 297/325
6,352,275 B1 * 3/2002 Lindenkamp ..... A61G 5/1054 280/47.4
6,669,294 B2 * 12/2003 Kinoshita ..... A47C 1/03255 297/301.1
6,739,664 B2 * 5/2004 Kinoshita ..... A47C 1/03255 297/301.2
7,784,815 B2 * 8/2010 Porcheron ..... A61G 5/14 280/47.38
7,802,846 B2 * 9/2010 Bellefleur ..... A47C 1/0244 297/307
9,084,708 B2 * 7/2015 Horvath ..... A61G 5/1059
11,712,382 B2 * 8/2023 Kelly ..... A47C 1/025 280/657

OTHER PUBLICATIONS

Raz Design Incorporated. "Rat-AT User Manual." Date: May 11, 2017. (Year: 2017).*

* cited by examiner

RECLINING MOVABLE BATH CHAIR

BACKGROUND OF THE INVENTION

(a) Field of the Invention

The present invention relates to a reclining movable bath chair, and more specifically relates to a reclining bath chair being additionally fitted with a pair of pin connected handles, a pair of linkage support rods, and upper tubes fitted to a base that are parallel to lower tubes thereof, enabling increasing the distance between a caregiver and a handgrip tube and a headrest, creating a safe distance and achieving an improved safety factor standard for the caregiver. Accordingly, when a headrest adjusting bar and a headrest are displaced downward, they will not suddenly impact the chest of the caregiver and cause injury. Moreover, gas cylinders enable buffering the speed of raising and descending when tilting the bath chair, at which time the patient under care is slowly displaced forward and descends, further moving their center of gravity forward, thus the patient will not have the feeling of falling over, making them feel more secure and improving the feeling of safety, and enabling the reclining movable bath chair of the present invention to be operated with less effort.

(b) Description of the Prior Art

As is known, physically challenged persons, invalids, or the elderly who are unable to move on their own, need a caregiver to help them relieve themselves and assist them when bathing. However, without special assistive apparatus, these actions are difficult for the caregiver to do on their own. Hence, a movable bath chair provides an excellent assistive apparatus for both the caregiver and the physically challenged person. A backrest of a traditional movable bath chair can be tilted to a specific angle, enabling changing the sitting position of a patient to a tilted lying position, making it easier for a caregiver to bathe and wash the hair of the physically challenged person. Referring to FIGS. 1, 2, and 3, which show a bath chair 10 that is movable, wherein the bath chair 10 comprises a square-shaped seat frame 11, a front foot U-shaped tube 12, a pair of front foot adjustable inclined tubes 13, a pair of brackets 14, a pair of footrests 15, a base 16, a set of two front wheels 161, a set of two rear wheels 162, a seat cushion 17, a backrest tube 111, a handgrip tube 112, a headrest adjusting bar 113, a headrest 114, a pair of gas cylinders 18, and a hand lever 115. The front foot U-shaped tube 12 is fixed and extends downward from the front end of the seat frame 11, and the brackets 14 are mounted on the front foot U-shaped tubes 12, thereby enabling the brackets 14 to connect to the front foot adjustable inclined tubes 13. The lower portions of the front foot adjustable inclined tubes 13 are respectively pin connected to the footrests 15. The seat cushion 17 is assembled to the seat frame 11, and the seat cushion 17 is provided with a large oval cover 171, similar to a toilet seat, enabling a physically challenged person to directly relieve themselves by opening the oval cover 171 to allow their discharge to fall into a container 172 below. The rear portion of the seat frame 11 enables assembling the backrest tube 111 thereto, which is an U-shaped tube. The handgrip tube 112 is mounted on the backrest tube 111, and enables pushing, pulling and pressing with human hands. The headrest adjusting bar 113 is assembled to the handgrip tube 112, and the headrest 114 is assembled to the headrest adjusting bar 113. A backrest cushion 116 and a pair of armrest tubes 117 are mounted to the backrest tube 111.

The base 16 is a horizontal U-shaped form, the lower portion of which has a pair of lower tubes 163, and the upper portion has a pair of upper tubes 164. A particularly bulging section of each of the upper tubes 164 is the upper pin section 1641, and a pin section 165 is fixed to each of the upper pin sections 1641. The pin sections 165 are pin connected to the seat frame 11. Each of the gas cylinders 18 has a piston rod 181 and a release mechanism 182, wherein the bottom ends of the piston rods 181 respectively penetrate into the gas cylinders 18, and the top ends of the piston rods 181 are respectively positioned inside the release mechanisms 182. The hand lever 115 is assembled to the handgrip tube 112, wherein the hand lever 115 connectively links cords (retractable steel wires) to the interior of the release mechanisms 182. The hand lever 115 enables unlocking the release mechanisms 182 to release the air pressure of the gas cylinders 18, thereby causing the piston rods 181 to descend and retract within the respective gas cylinders 23. The bottom ends of the gas cylinders 18 are respectively pin connected to the lower tubes 163 of the base 16 slightly forward of the centers thereof, and the release mechanisms 182 are respectively pin connected to the rear ends of the seat frame 11.

When the patient being cared for sits on the seat cushion 17, a caregiver grips the handgrip tube 112 to push or pull the bath chair 10. If the patient being cared for needs to be tilted backward, the caregiver grips and presses the hand lever 115 on the handgrip tube 112, whereupon the hand lever 115 connectively links the cords 118 to the release mechanisms 182, thereby unlocking the release mechanisms 182 to release the air pressure in the gas cylinders 182, which, under the weight of the patient being cared for and the caregiver pressing the hand lever 115, causes the piston rods 181 to descend (the piston rods 181 retract into the gas cylinders 18), causing the seat frame 11 and the seat cushion 17 to tilt to a specific angle while also lifting the front foot adjustment inclined tubes 13 and the footrests 15, as well as concurrently tilting the backrest tube 111, the headrest adjusting bar 113, and the headrest 116; only the base 16 remains motionless, supporting the seat frame 11. Accordingly, the patient under care is caused to assume a tilted backward position, making it convenient for a caregiver to bathe and wash the hair of the patient.

The main tilt angle of the traditional bath chair 10 is mostly determined by the gas cylinders 18, which enable achieving a definite value for the tilt angle. If the maximum tilt angle is called the 6 tilt angle, as shown in FIG. 4, that is, the main tilt angle value produced after tilting the bath chair 10 by the angle θ, then the horizontal distance from the axis center of the front wheels 161 to the handgrip tube 112 (X axial direction) is A (772.74 mm); the horizontal distance from the rear end of the rear wheels 162 to the handgrip tube 112 (X axial direction) is B (194.09 mm), the vertical distance from the rear end of the seat cushion 17 to the floor (Y axial direction) is C (340.88 mm); the horizontal distance from the rear end of the seat cushion 17 to the handgrip tube 112 (X axial direction) is D (413.35 mm); and the distance between the handgrip tube 112 and the floor is E (668.15 mm). Hence, when a caregiver grips the handgrip tube 112, wherein the caregiver's arm is a certain value, using the rear end of the seat cushion 17 as the center of rotation, then the radius value of rotation D is considerably large; the B value is also large; and the height C value of the rear end of the seat cushion 17 from the floor is extremely low. Accordingly, when tilting the bath chair 10, the overall center of gravity quickly moves backward, causing the bath chair 10 to quickly descend, which easily results in the headrest adjusting bar 113, the headrest 114, and the handgrip tube 112 impacting the chest of the caregiver and causing injury. Moreover, because of the quick descent of the bath chair 10, the patient under care will have an overwhelming feeling of insecurity that they are about to tip over.

Hence, the traditional bath chair 10 has the following shortcomings:

1. the radius value of rotation D exceeds the length value B, thus, when the headrest adjusting bar 113, the headrest 114, and the handgrip tube 112 are displaced downward, they easily impact the chest of the caregiver and cause injury;
2. when tilting the bath chair 10, the rear end of the seat cushion 17 has descended to a very low C value from the floor, and because of the quick descent of the bath chair 10, the patient under care will have an overwhelming feeling of insecurity that they are about to tip over;
3. regardless of whether rising or descending, the bath chair 10 has no buffering components, causing the bath chair 10 to quickly descend when tilting, and quickly return to its original position when ascending, making the patient under care feel uncomfortable; moreover, because the caregiver is unable to react in time, they are easily impacted by components on the bath chair 10;
4. because the length values of D and B are considerably large, and the C value is small, If a caregiver encounters a patient under care who weighs a lot, when the caregiver presses the hand lever 115 on the handgrip tube 112 to release the pressure in the gas cylinders 23, the bath chair 10 quickly descends, and if the caregiver wants to immediately stop the bath chair 10 from descending any further, or doesn't want the bath chair 10 to tilt at the maximum tilt angle θ, in addition to the caregiver releasing the hand lever 115, the caregiver also needs to use a considerable effort to lift the handgrip tube 112, which is a major problem and obstacle for the caregiver;
5. in order for the seat cushion 17 to achieve a tilt angle of θ, the upper pin section 1641 is particularly configured as a bulging section of each of the upper tubes 164, which are used to raise the seat cushion 17, and the pin sections 165 are fixed to each of the upper pin sections 1641; however, the pin sections 165 provide insufficient support; If a caregiver encounters a patient under care who weighs a lot, the seat frame 11 and the seat cushion will 17 easily sway when moving or tilting the bath chair 10, causing an uncomfortable feeling for the patient;
6. for caregivers of slight build, or caregivers with less strength, a lot of effort is required from them to operate the bath chair 10, and even results in improper operation, causing injury to the person under care or the caregiver, especially if the caregiver encounters a patient under care who weighs a lot, requiring even greater effort to operate the bath chair 10, and is thus extremely inconvenient.

SUMMARY OF THE INVENTION

A bath chair of the present invention comprises:

a seat frame, the front end of which is provided with a front foot U-shaped tube, which enables a pair of brackets to be mounted thereto, each of the brackets is connected to a front foot adjustable sloped tube and a footrest, a seat cushion is clamped to the seat frame;

a base and a pair of gas cylinders, each of the lower two sides of the base has a lower tube, and each of the upper two sides of the base has an upper tube, each of the gas cylinders has a piston rod and a release mechanism, the release mechanisms and the top ends of the piston rods are respectively pin connected to the sides of the seat frame, and the bottom ends of the gas cylinders are respectively pin connected to the lower tubes of the base; and a pair of backrest tubes, which are respectively assembled inside the two rear ends of the seat frame, a handgrip tube is mounted above and between the two backrest tubes, a hand lever is assembled to the handgrip tube, the hand lever connectively links cords to the interior of the release mechanisms, a backrest cushion is mounted between the two backrest tubes, and an armrest tube is assembled to each of the backrest tubes, a headrest adjusting bar is assembled to the handgrip tube, and a headrest is assembled to the headrest adjusting bar.

The present invention is characterized in that: the bath chair is fitted with a pair of pin connected handles, a pair of linkage support rods, and the upper tubes of the base are parallel to the lower tubes, the seat frame is pin connected to the upper ends of the pin connected handles, and the lower ends of the pin connected handles are pin connected to the upper tubes of the base, the upper tubes are straight tubes, and the linkage support rods are pin connected between the rear ends of the base and close to the rear ends of the seat frame.

The main object of the present invention lies in additionally fitting the bath chair with three major components including the pair of pin connected handles, the pair of linkage support rods, and the pair of gas cylinders, wherein the upper tubes of the base are parallel to the lower tubes thereof, thereby enabling increasing the distance between a caregiver and the handgrip tube and the headrest, thus creating a safe distance and achieving an improved safety factor standard for the caregiver. Hence, when the headrest adjusting bar and the headrest are displaced downward, they will not suddenly impact the chest of the caregiver and cause injury.

A second object of the present invention lies in enabling the bath chair to slowly move a patient under care forward and gradually descend, thus further moving their center of gravity forward. Hence, the patient will not have the feeling of falling over, making them feel more secure and Improving the feeling of safety.

Another object of the present invention lies in providing the bath chair with the pin connected handles of a specific length, which support the seat frame, wherein the cross-section of each of the pin connected handles assumes a H-shape, which can be formed by combining any two shaped pieces, such as squared inverted U shapes, U shapes, or square shapes. The top and bottom sides are balanced, thereby improving the safety factor, whereby the upper ends are pin connected to and stabilize the bottom portion of the seat frame, and the lower ends are pin connected to and stabilize upper tube pin connecting tubes of the base, further stabilizing the seat frame and the seat cushion. If a caregiver encounters a patient under care who weighs a lot, when moving or tilting the bath chair, the seat frame and the seat cushion will not easily sway, providing a comfortable feeling for the patient.

Yet another object of the present invention lies in additionally installing the bath chair with the pair of linkage support rods, the function of which is to buffer the force and speed of the rising and descending bath chair.

Yet another object of the present invention lies in providing the configuration of the pin connected handles, the linkage support rods, and the gas cylinders connectively linking to other components, to enable caregivers of slight build, or caregivers with less strength to expend less effort to operate the bath chair. In particular, when a caregiver encounters a patient under care who weighs a lot, operating the bath chair requires even less effort compared to the traditional bath chair.

To enable a further understanding of said objectives, structures, characteristics, and effects, as well as the technology and methods used in the present invention and effects achieved, a brief description of the drawings is provided below followed by a detailed description of the preferred embodiments.

DETAILED DESCRIPTION OF THE PREFERRED EMBODIMENTS

Figure 5:
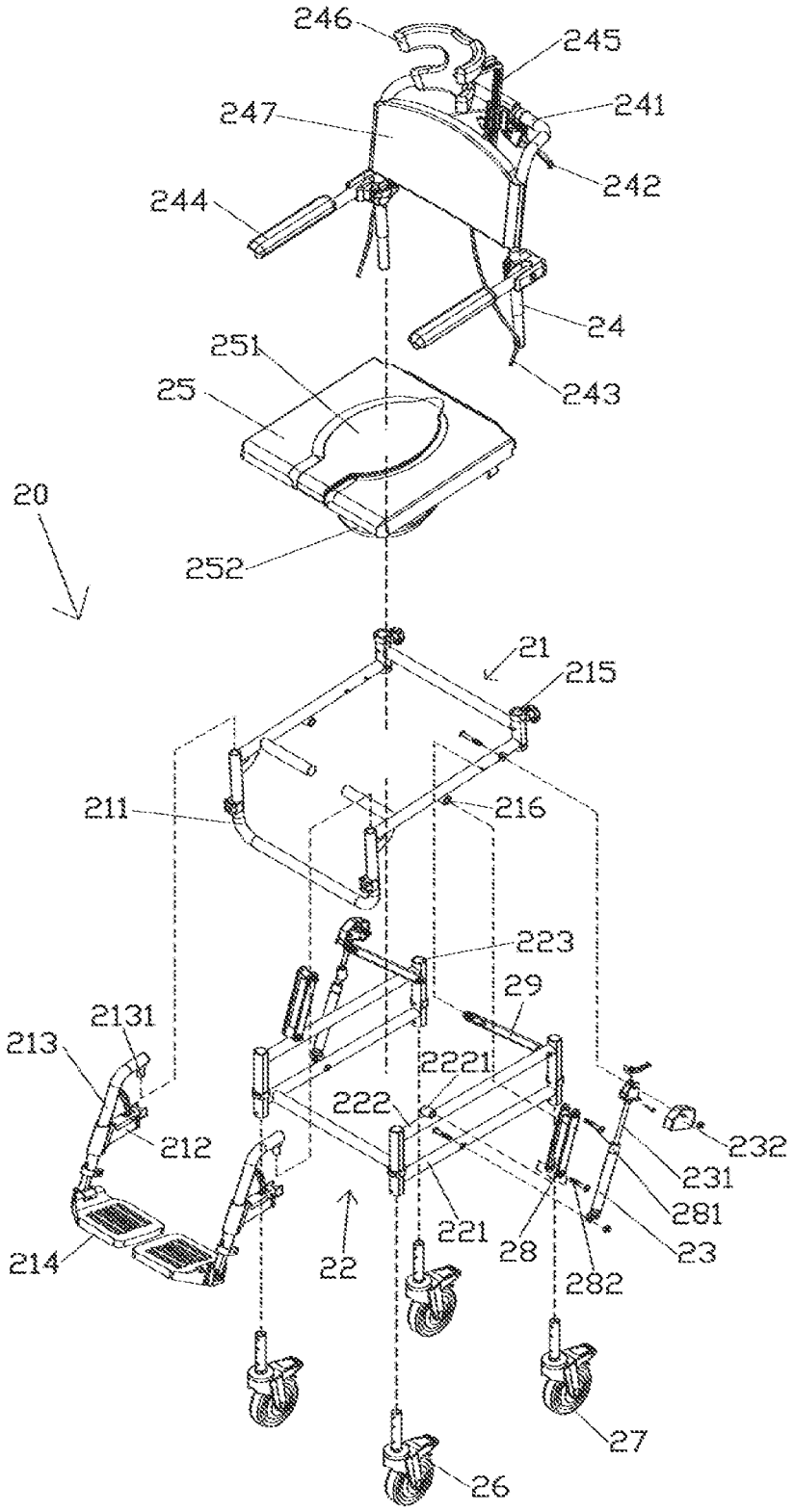
FIG. 5 is an exploded three-dimensional schematic view of a bath chair of the present invention.
Figure 6:
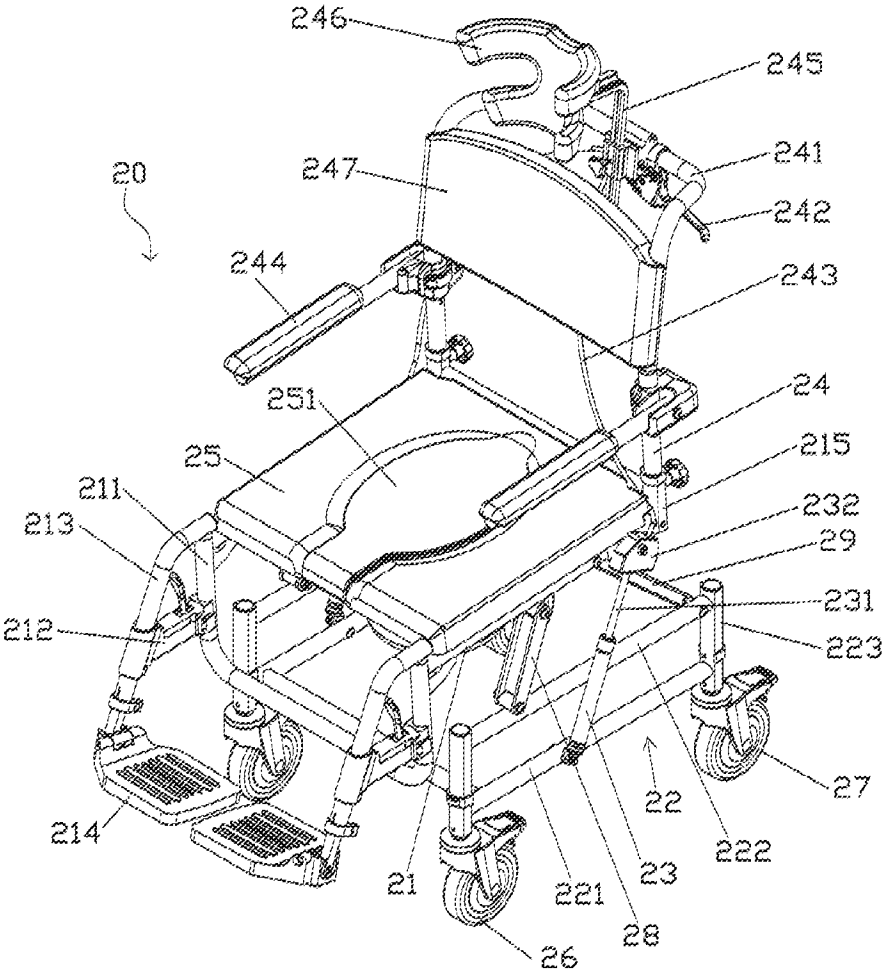
FIG. 6 is a three-dimensional schematic view of the assembled bath chair of the present invention.
Figure 7:
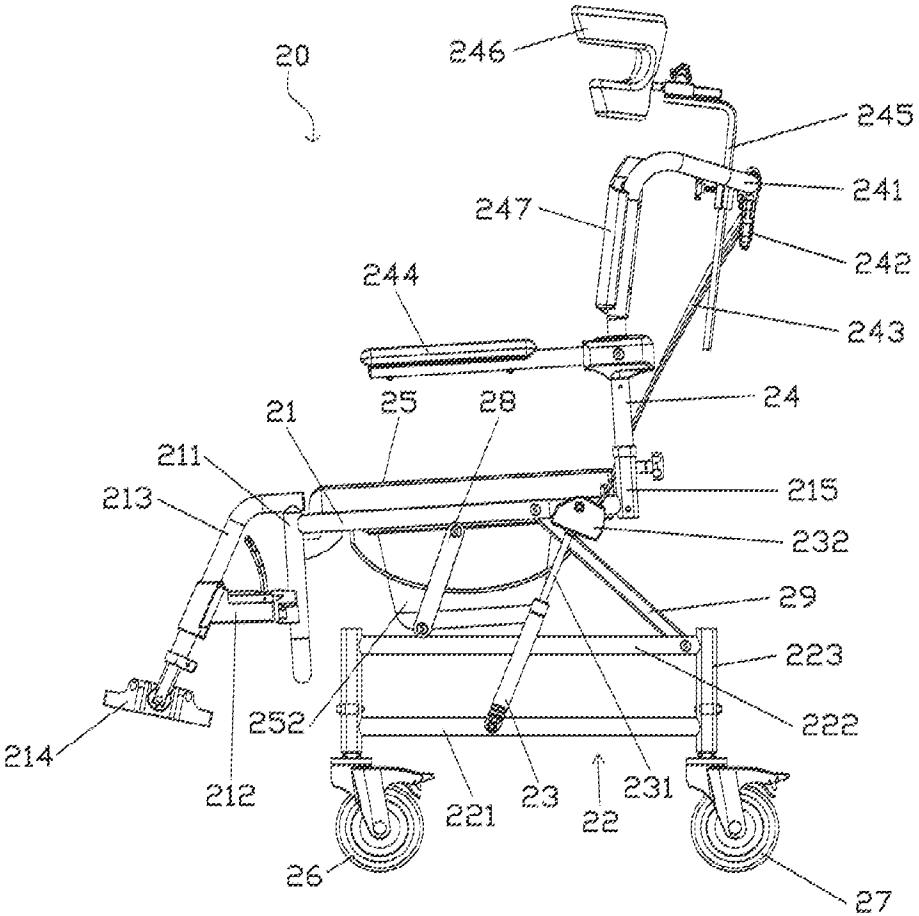
FIG. 7 is a side planar schematic view of the present invention.

Referring to FIGS. 5 to 7, which show a bath chair 20 of the present invention, comprising a seat frame 21, a base 22, a pair of gas cylinders 23, and a pair of backrest tubes 24, wherein the seat frame 21 is pin connected to the upper portion of the base 22, and the base 22 supports movement of the seat frame 21. The seat frame 21 assumes a square-shaped frame, and a front foot U-shaped tube 211 is fixed to and extends downward from the front end of the seat frame 21, wherein the front foot U-shaped tube 211 enables a pair of brackets 212 to be mounted thereto. Each of the brackets 212 is connected to a front foot adjustable inclined tube 213 and a footrest 214, and each of the front foot adjustable inclined tubes 213 has a downward protruding clasp post 2131, which are respectively inserted into the top ends of the front foot U-shaped tube 211. The brackets 212 are connected to the front foot adjustable inclined tubes 213, the lower portions of which are respectively pin connected to the footrests 214. A seat cushion 25 is mounted and clamped to the seat frame 21. The seat cushion 25 has a large oval cover 251, and a large container 252 is assembled there below, similar to a toilet seat, enabling a physically challenged person to directly relieve themselves by opening the oval cover 251 to allow the person's discharge to fall into the container 252 below. A seat frame rear bushing 215 is fitted to each of the two rear ends of the seat frame 21, and a seat frame pin connecting tube 216 is fixed to each bottom portion on the two sides of the seat frame 21.

Figure 8:
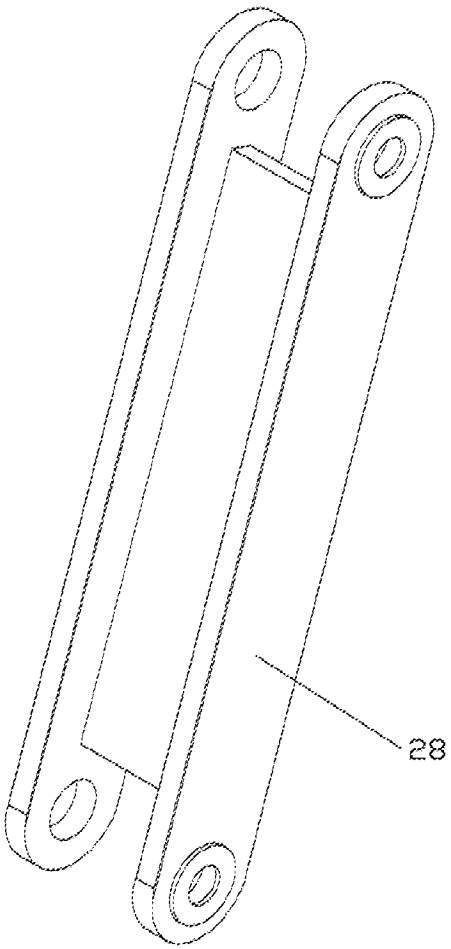
FIG. 8 is an enlarged three-dimensional schematic view of a pin connected handle of the present invention.

The base 22, which assumes a horizontal U-shaped form, is fitted with the pair of gas cylinders 23, and has two tubes on the two sides thereof, all of which are hollow tubes. The lower tube on the two sides is a lower tube 221, and the upper tube on the two sides is an upper tube 222. The upper tubes 222 are parallel to the lower tubes 221. The upper tubes 222 are straight tubes, and are not configured with a bulging section as in the traditional bath chair. A base rear tube 223 is fitted to each of the two rear ends of the base 22, and an upper tube pin connecting tube 2221 is fixed to each upper tube 222 of the base 22. Each of the gas cylinders 23 has a piston rod 231 and a release mechanism 232, wherein the bottom end of the piston rod 231 penetrates into the gas cylinder 23; the top end of the piston rod 231 is positioned inside the release mechanism 232, with the release mechanism 232 and the top end of the piston rod 231 being pin connected to the side of the seat frame 21. The bottom end of each of the gas cylinders 23 is pin connected to the respective lower tube 221 of the base 22 slightly forward of the centers thereof. A front wheel 26 is pin connected to each of the two bottom end front corners of the base 22, and a rear wheel 27 is pin connected to each of the two bottom end rear corners of the base 22. The bath chair 20 of the present invention is additionally fitted with a pair of pin connected handles 28 (see FIG. 8), the cross-section of each of which assumes a H-shape. The upper ends of the pin connected handles 28 are respectively pin connected to the seat frame 21 pin connecting tubes 216 at the bottom portions of the seat frame 21 using bolts 281, and the lower ends of the pin connected handles 28 are pin connected to the upper tube pin connecting tubes 2221 of the base 22 using bolts 282. In addition, a pair of linkage support rods 29 are pin connected between the rear ends of the base 22 and the rear ends of the seat frame 21, wherein the inner sides of the base rear tubes 223 enable the bottom ends of the linkage support rods 29 to respectively pin connect thereto, and the top ends of the linkage support rods 29 are then respectively pin connected to the two outer sides of the seat frame 21 close to the rear-end area.

The pair of backrest tubes 24 are respectively assembled inside the seat frame rear bushings 215 of the seat frame 21, and a handgrip tube 241 is fitted on the upper portion between the two backrest tubes 24. A hand lever 242 is assembled to the handgrip tube 241 and connectively links cords 243 (retractable steel wires) to the interior of the release mechanisms 232. The hand lever 242 enables unlocking the release mechanisms 232 to release the air pressure of the gas cylinders 23, thereby causing the piston rods 231 to descend and retract within the respective gas cylinders 23. An armrest tube 244 is assembled to each of the backrest tubes 24. The handgrip tube 241 is assembled with a headrest adjusting bar 245, a headrest 246 is assembled to the headrest adjusting bar 245, and a backrest cushion 247 is fitted between the two backrest tubes 24.

The main characteristics of the present invention lie in: additionally fitting the bath chair 20 with the pair of pin connected handles 28, the pair of linkage support rods 29, and the upper tubes 222 of the base 22 being parallel to the lower tubes 221. Moreover, the seat frame 21 is pin connected to the upper ends of the pin connected handles 28, and the lower ends of the pin connected handles 28 are pin connected to the upper tubes 222 of the base 22. The linkage support rods 29 are pin connected between the rear ends of the base 22 and close to the rear ends of the seat frame 21.

Figure 9:
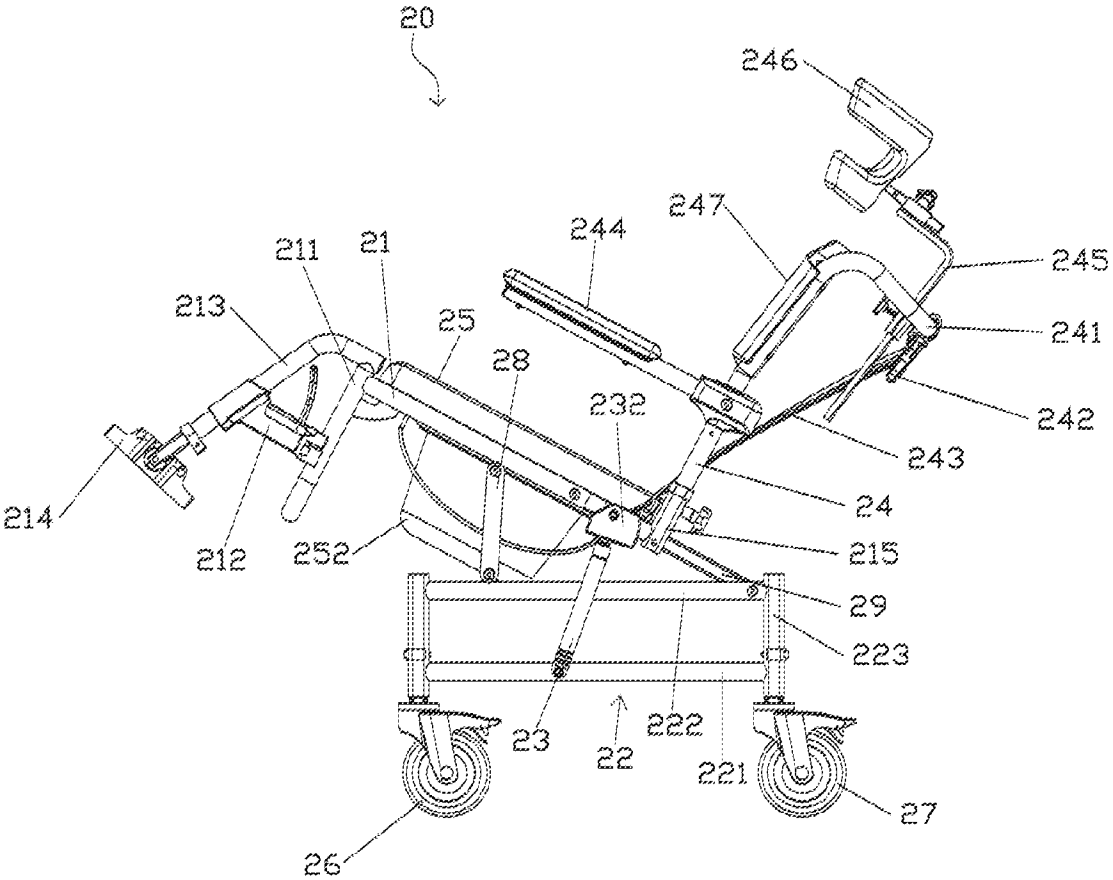
FIG. 9 is a side planar schematic view of the present invention in a reclined position.

According to the above-described structural assembly of the present invention, referring to FIGS. 7 and 9, when operating the bath chair 20 to adjust the tilt angle thereof, a caregiver grips the handgrip tube 241 and presses the hand lever 242, whereupon the hand lever 242 connectively links the cords 243 to the release mechanisms 232, thereby unlocking the release mechanisms 232 to release the air pressure in the gas cylinders 23, causing the piston rods 231 to descend and retract within the respective gas cylinders 23, after which, due to the weight of the patient sitting on the seat cushion 25 and the caregiver applying a force downward on the handgrip tube 241, the seat frame 21 gradually tilts. The linkage support rods 29 originally form an angle with the seat frame 21, and upon tilting the bath chair 20, the linkage support rods 29 are gradually almost in straight alignment with the seat frame 21, whereupon the caregiver can let go of the hand lever 242, thereby locking the release mechanisms 232 and the gas cylinders 23, and fixedly positioning the piston rods 231. At this time, the body of the patient sitting on the seat cushion 25 is in a half lying down position, that is, in a reclining position, which makes it easier for the caregiver to wash the patient's hair or body. To return the bath chair 20 to its original sitting position, the caregiver only needs to press the hand lever 242 again, whereupon the hand lever 242 connectively links the cords 243 to the release mechanisms 232, unlocking them to release the air pressure in the gas cylinders 23; moreover, the caregiver applies force to upwardly displace the handgrip tube 241 to cause the piston rods 231 to extend from the respective gas cylinders 23, thereby enabling the seat cushion 25 to gradually become parallel to the floor, whereupon the linkage support rods 29 again form an angle with the seat frame 21, at which time the caregiver can let go of the hand lever 242, which locks the release mechanisms 232 and the gas cylinders 23, and fixedly positions the piston rods 231, restoring the patient's body to a sitting position.

Figure 1:
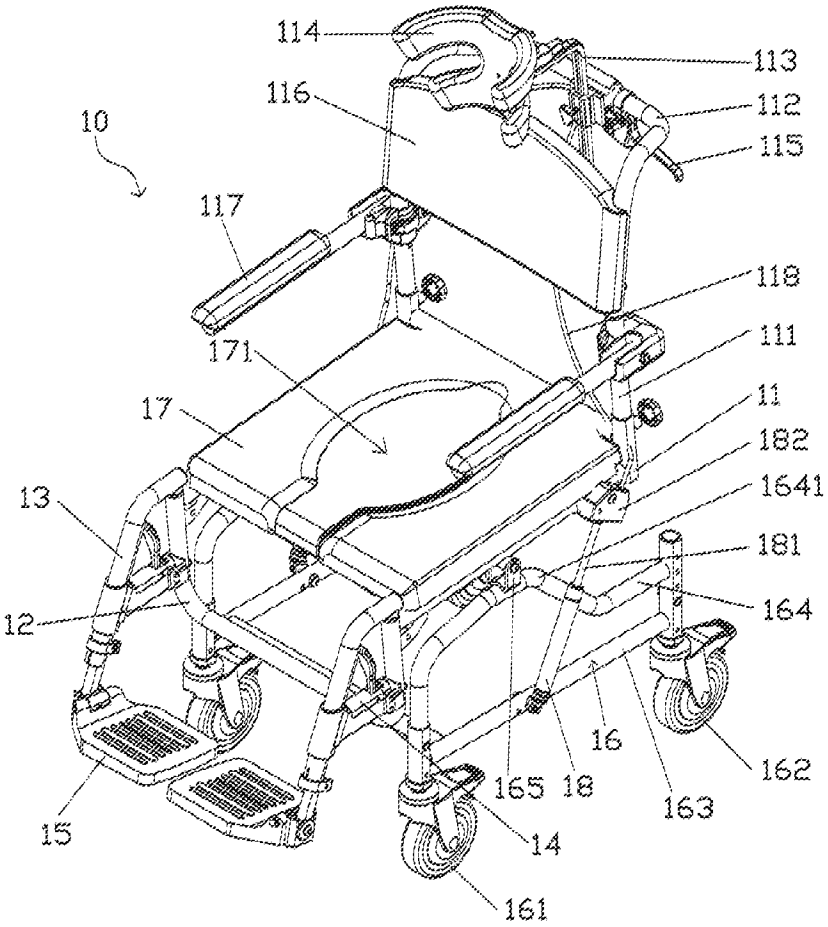
Fig. 1 Prior Art
FIG. 1 is a three-dimensional schematic view of an assembled movable bath chair of the prior art.
Figure 2:
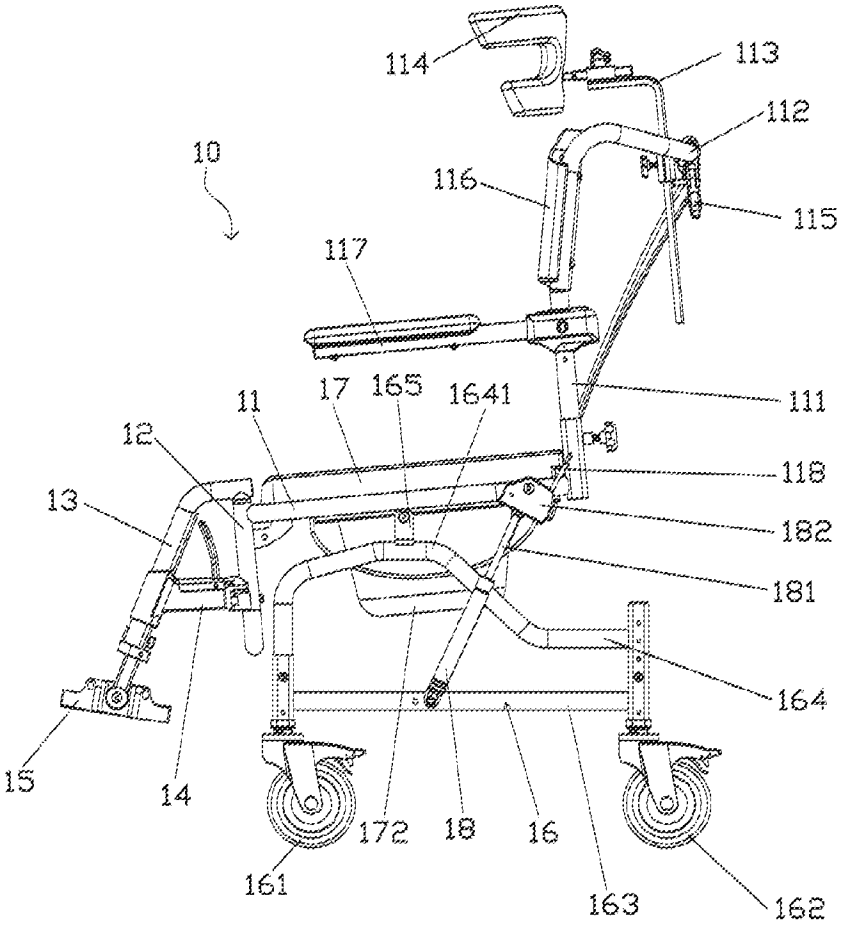
Fig. 2 Prior Art
FIG. 2 is a side planar schematic view of the movable bath chair of the prior art.
Figure 3:
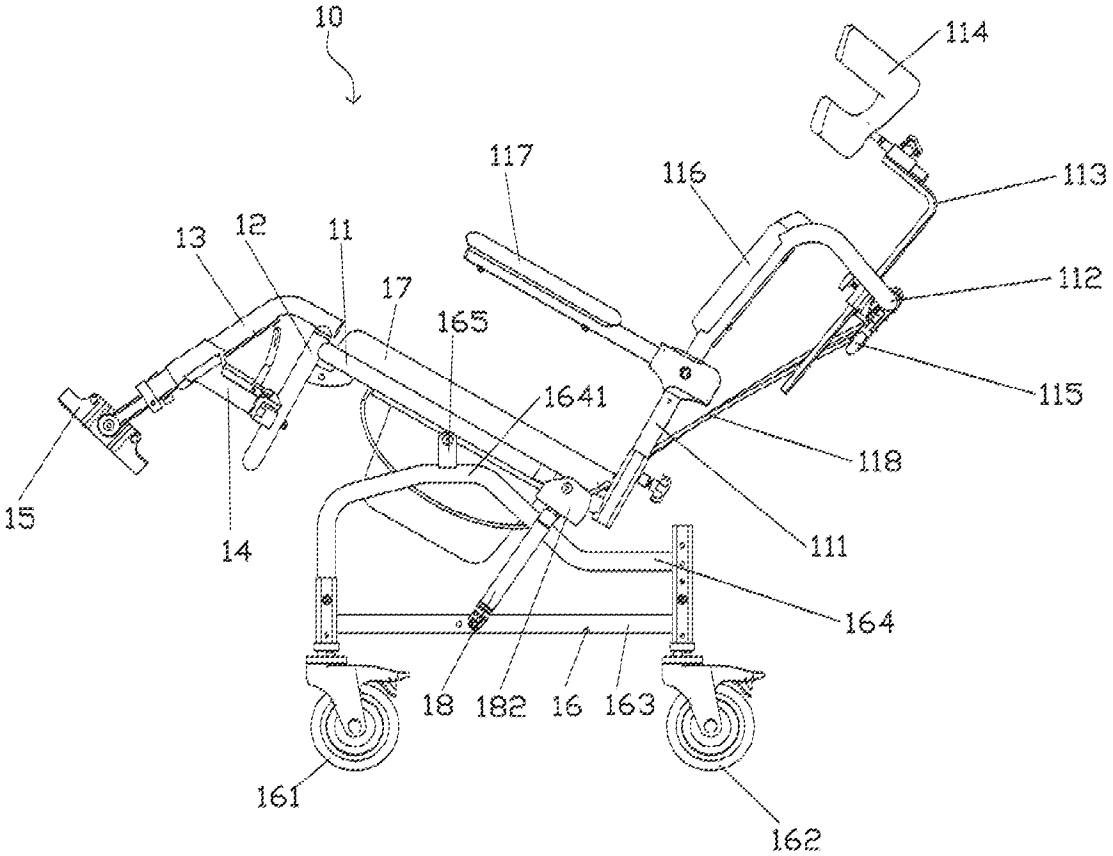
Fig. 3 Prior Art
FIG. 3 is a side planar schematic view of the movable bath chair of the prior art in a reclined position.
Figure 4:
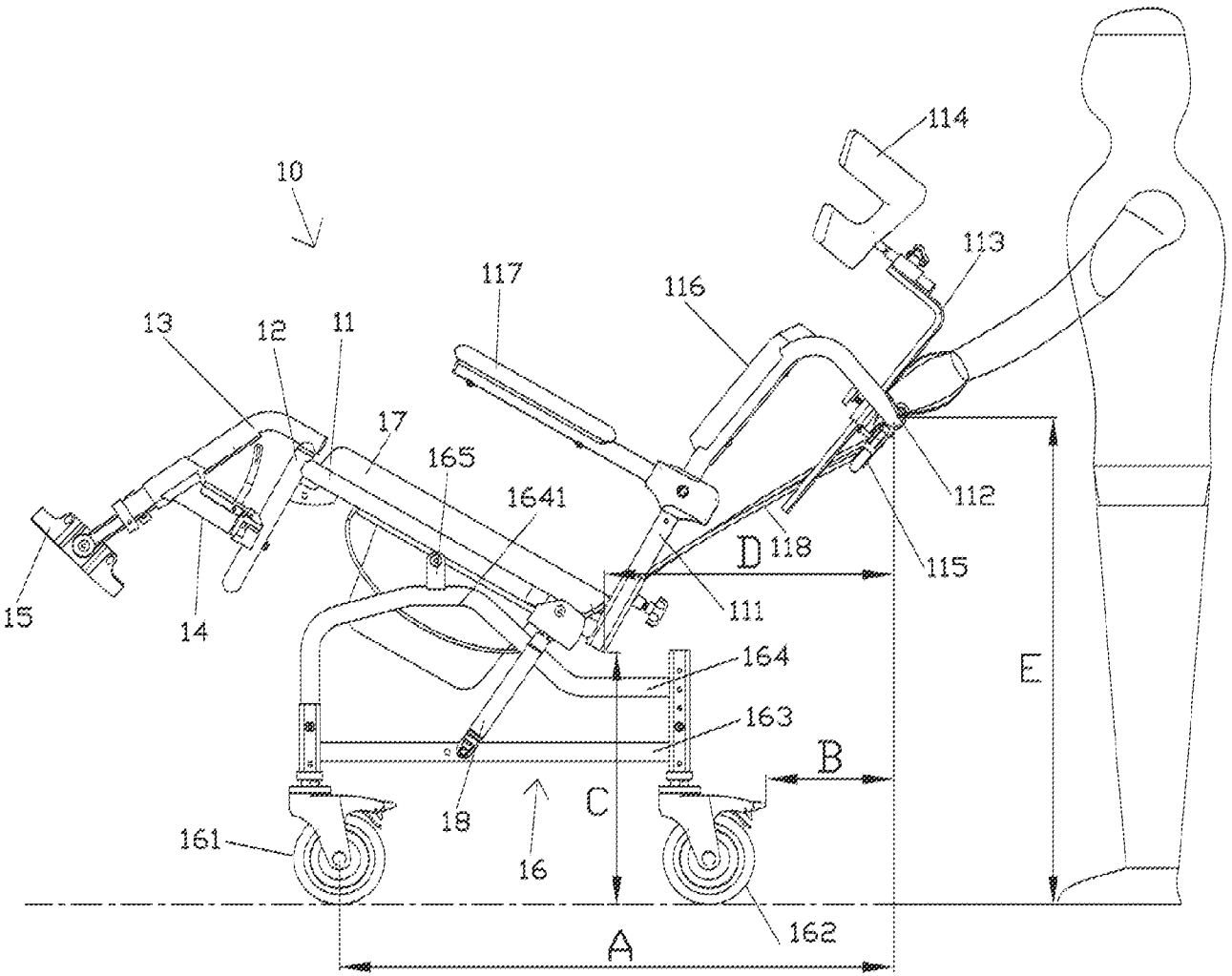
Fig. 4 Prior Art
FIG. 4 is a planar schematic view showing each main length of the reclined movable bath chair of the prior art.
Figure 10:
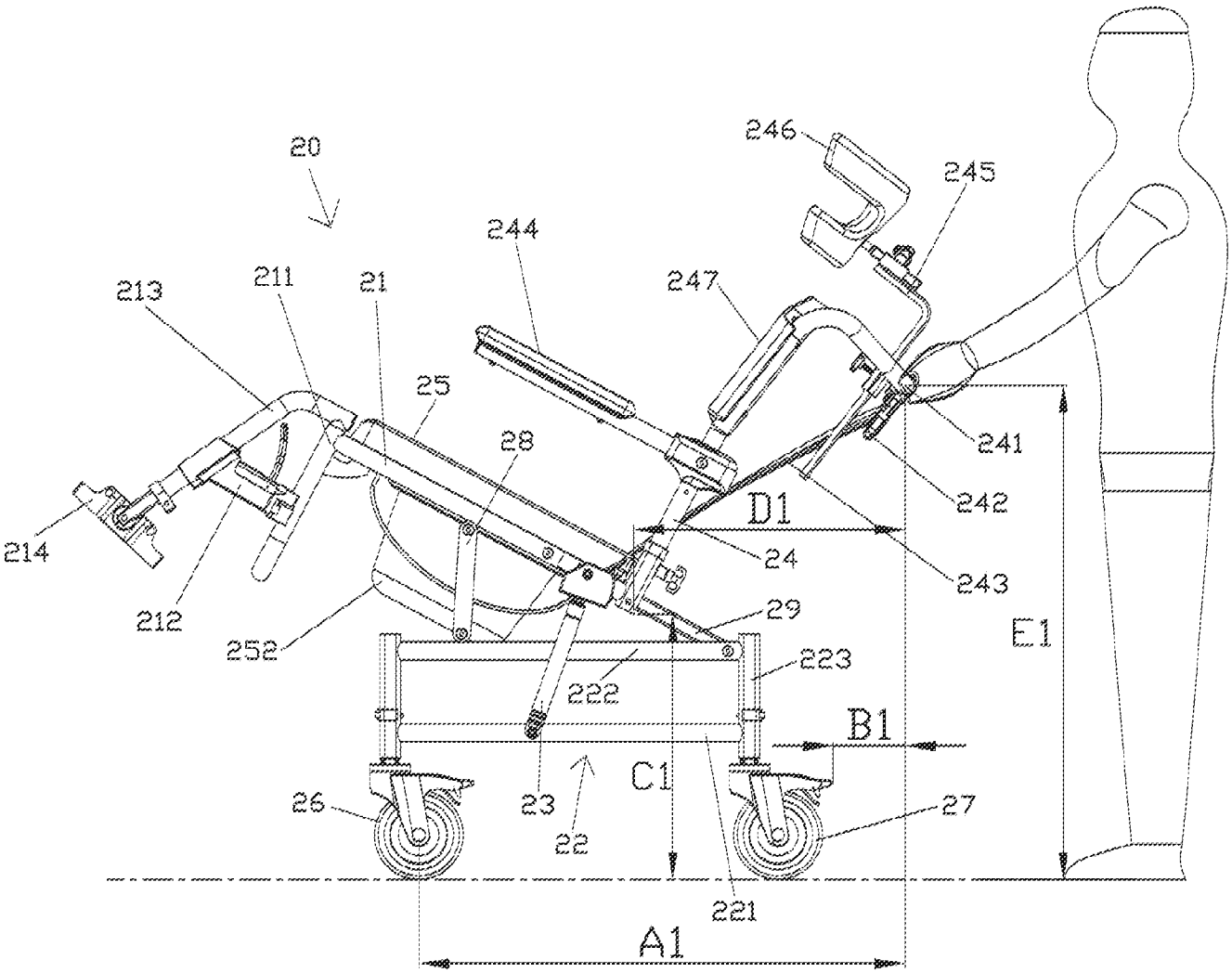
FIG. 10 is a planar schematic view showing each main length of the present invention in a reclined position.

The present invention enables achieving a definite value for the tilt angle of the bath chair 20, which compared to the various distance values of the traditional movable bath chair with a maximum tilt angle θ, as shown in FIG. 4, the corresponding distance values of the bath chair of the present invention shown in FIG. 10 are as follows: the horizontal distance from the axis center of the front wheels 26 to the handgrip tube 241 (X axial direction) is A1 (701.75 mm); the horizontal distance from the rear-end of the rear wheels 27 to the handgrip tube 241 (X axial direction) is B1 (124.22 mm); the vertical distance from the rear end of the seat cushion 25 to the floor (Y axial direction) is C1 (367.67 mm); and the horizontal distance from the rear end of the seat cushion 25 to the handgrip tube 241 (X axial direction) is D1 (398.93 mm). When a caregiver grips the handgrip tube 241, the distance between the handgrip tube 241 and the floor is E1 (694.74 mm), wherein the caregiver's arm length is a certain value. Comparing the above-described numerical values of the present invention with the corresponding numerical values of the traditional bath chair 10 (shown in FIG. 4): A1<A, B1<B, C1>C, D1<D, and E1>E. Using the rear end of the seat cushion as the center of rotation for the radius of rotation D1 (398.93 mm), this value is much smaller than the corresponding value D (413.35 mm) for the traditional bath chair 10; the value for B1 (124.22 mm) is much smaller than the corresponding value B (194.09 mm) for the traditional bath chair 10; the height of the rear end of the seat cushion 25 from the floor C1 (367.67 mm) is slightly higher than the corresponding value C (340.88 mm) for the traditional bath chair 10; and the distance between the handgrip tube 241 and the floor E1 (694.74 mm) is higher than the corresponding value E (668.15 mm) for the traditional bath chair 10. Due to the linkage of the linkage supports rod 29, when tilting the bath chair 20, the overall center of gravity moves slowly forward and backward, thereby avoiding giving an unsafe feeling of quickly descending for the patient under care. Furthermore, the D1 value is smaller than the D value, and the B1 value is smaller than the B value, allowing the chest of a caregiver to keep away from the headrest adjusting bar 245, the headrest 246, and the handgrip tube 241, and thus preventing the caregiver from being hit by them. In addition, the pin connected handles 28 firmly support the seat frame 21, and the functional combination of the pin connected handles 28 and the linkage support rods 29 eliminates the need for a large tilt of the gas cylinders 23 (compared to the tilt of the gas cylinders in the traditional bath chair 10) while still achieving the maximum tilt angle of the traditional bath chair.

The present invention is provided with the following advantages:

1. provides three major components, including the pair of pin connected handles 28, the pair of linkage support rods 29, and the pair of gas cylinders 23, wherein the pin connected handles 28 and the linkage support rods 29 are additional components. Moreover, the upper tubes 222 are parallel to the lower tubes 221, the radius of rotation D is shorter and the length B is shorter. The D1 value is displaced 15 mm forward relative to the center point of the D value of the traditional bath chair 10, thereby correspondingly increasing the distance between the caregiver and the handgrip tube 241 and the headrest 246 (a caregiver's arm being of a certain length value). This provides a safe distance and increases the safety factor for the caregiver, whereby when the headrest adjusting bar 245, the headrest 246, and the handgrip tube 241 are displaced downward, they will not impact the chest of the caregiver and cause injury;
2. additionally installed with the pair of linkage support rods 29, the function of which is to buffer the force and speed of the rising and descending bath chair 20;
3. when tilting the bath chair 20, the height of the rear end of the seat cushion 25 from the floor C1 is higher than the corresponding value C for the traditional bath chair 10, and the height of the handgrip tube 241 from the floor E1 is higher, thereby enabling achieving a maximum tilt angle. Moreover, when the bath chair 20 is tilted, the patient under care slowly moves forward and descends, and their center of gravity is displaced forward, thus eliminating the feeling of falling over by the patient, and making them feel more secure;
4. compared to the traditional bath chair, because the values for D1 and B1 are smaller, and the value for C is greater, when a caregiver encounters a patient under care who weighs a lot, the caregiver presses the hand lever 242 on the handgrip tube 241 to release the air pressure in the gas cylinders 23, thereby causing the bath chair 20 to slowly descend. If the caregiver wants to immediately stop the bath chair 20 from descending any further or doesn't want the bath chair 20 to tilt at the maximum tilt angle θ, the caregiver need only release the hand lever 242, thus eliminating the need to use a considerable effort to lift the handgrip tube 241, saving on effort to achieve the task and providing a great convenience for the caregiver;

5. the seat cushion 25 can achieve a tilt angle of θ, and has no need for a special bulge on each of the upper tubes 222 to act as an upper pin section, as configured in the traditional bath chair 10, to raise the seat cushion 25, and also has no need for pin connected sections (the pin connected sections provide insufficient support); instead the present invention is provided with the pin connected handles 28 of specific length, which support the height of the seat frame 21. The cross-section of each of the pin connected handles 28 assumes a H-shape, wherein the H-shape can be formed by combining any two shaped pieces, such as squared inverted U shapes, U shapes, or square shapes. The top and bottom sides of the bath chair 20 are balanced, improving the safety factor thereof, with the upper ends of the pin connected handles 28 stabilizing the bottom portion of the seat frame 21, and the lower ends stabilizing the upper tube pin connecting tubes 2221 of the base 22, further stabilizing the seat frame 21 and the seat cushion 25. If a caregiver encounters a patient under care who weighs a lot, when moving or tilting the bath chair 20, the seat frame 21 and the seat cushion 25 will not easily sway, providing a comfortable feeling for the patient;

6. for caregivers of slight build, or caregivers with less strength, because of the configuration of the pin connected handles 28, the linkage support rods 29, and the gas cylinders 23 connectively linking to other components, less effort is required to operate the bath chair 20. In particular, when a caregiver encounters a patient under care who weighs a lot, operating the bath chair 20 requires even less effort compared to the traditional bath chair 10.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A reclining movable bath chair, wherein the bath chair comprises:

a seat frame, which is a square-shaped frame, a front foot U-shaped tube extends downward from a front end of the seat frame, wherein the front foot U-shaped tube enables mounting a pair of brackets thereto, each of the brackets is connected to a front foot adjustable inclined tube and a footrest, a seat cushion is mounted and clamped to the seat frame, and the seat cushion is provided with an oval cover, a container is fitted below the oval cover;

a base and a pair of gas cylinders, the base is a horizontal U-shaped form, with two tubes configured on both sides thereof, a lowest of the two tubes on the two sides is a lower tube, and an uppermost of the two tubes on the two sides is an upper tube, each of the gas cylinders has a piston rod and a release mechanism, bottom ends of the piston rods respectively penetrate into the gas cylinders, and top ends of the piston rods are positioned inside the release mechanisms, the release mechanisms and the top ends of the piston rods are respectively pin connected to the sides of the seat frame, the bottom ends of the gas cylinders are respectively pin connected to the lower tubes of the base slightly forward of the centers thereof, a front wheel is pin connected to each of the two bottom end front corners of the base, and a rear wheel is pin connected to each of the two bottom end rear corners of the base;

a pair of backrest tubes, which are respectively assembled inside two rear ends of the seat frame, a handgrip tube is fitted above and between the two backrest tubes, a hand lever is assembled to the handgrip tube, and the hand lever connectively links cords to an interior of the release mechanisms, wherein the hand lever unlocks the release mechanisms, which releases air pressure inside the gas cylinders, thereby causing the piston rods to descend and retract inside the gas cylinders, a backrest cushion is fitted between the two backrest tubes, and each of the backrest tubes has an armrest tube assembled thereto, a headrest adjusting bar is assembled to the handgrip tube, and a headrest is assembled to the headrest adjusting bar;

wherein, the bath chair is further fitted with a pair of pin connected handles, a pair of linkage support rods, and the upper tubes of the base are parallel to the lower tubes, the seat frame is pin connected to the upper ends of the pin connected handles, and the lower ends of the pin connected handles are pin connected to the upper tubes of the base, the upper tubes are straight tubes, and the linkage support rods are pin connected between the rear ends of the base and close to the rear ends of the seat frame.

2. The reclining movable bath chair according to claim 1, wherein each of the two rear ends of the seat frame has a seat frame rear bushing, which enables assembling the backrest tubes therein.

3. The reclining movable bath chair according to claim 1, wherein each of the front foot adjustable inclined tubes has a downward protruding clasp post, which are respectively inserted into the top ends of the front foot U-shaped tube.

4. The reclining movable bath chair according to claim 1, wherein each of the two rear ends of the base has a base rear tube, and the inner sides of the base rear tubes enable the bottom ends of the linkage support rods to respectively pin connect thereto, the top ends of the linkage support rods are further pin connected to the two outer sides of the seat frame.

5. The reclining movable bath chair according to claim 1, wherein the cross-section of each of the pin connected handles assumes a H-shape, a seat frame pin connecting tube is fixed to the bottom side on each of the two sides of the seat frame, enabling the top ends of the pin connected handles to pivot connect thereto using bolts, an upper tube pin connecting tube is fixed to each of the two upper tubes of the base, enabling the bottom ends of the pin connected handles to pin connect thereto using bolts.

* * * * *